US005517694A

United States Patent [19]

Fabry

[11] Patent Number: 5,517,694

[45] Date of Patent: May 21, 1996

[54] WEIGHTLIFTING GLOVE

[75] Inventor: John J. Fabry, Green Bay, Wis.

[73] Assignee: Fabry Glove and Mitten Company, Green Bay, Wis.

[21] Appl. No.: 340,157

[22] Filed: Nov. 15, 1994

[51] Int. Cl.[6] ..... A41D 19/00

[52] U.S. Cl. ..... 2/161.1; 2/161.4; 2/162

[58] Field of Search ..... 2/161.1, 161.2, 2/161.4, 161.5, 161.6, 162, 159, 161.3; 602/62, 64

[56] References Cited

U.S. PATENT DOCUMENTS

| | | | |
|---|---|---|---|
| D. 320,871 | 10/1991 | Bothof et al. . | |
| D. 335,368 | 5/1993 | Houston . | |
| 2,852,779 | 9/1958 | Roessler . | |
| 3,105,972 | 10/1963 | Christopher . | |
| 4,684,123 | 8/1987 | Fabry . | |
| 4,843,651 | 7/1989 | Gramza et al. | 2/161.1 |
| 4,850,341 | 7/1989 | Fabry et al. . | |
| 4,905,321 | 3/1990 | Walunga . | |
| 4,958,384 | 9/1990 | McCrane . | |
| 5,033,119 | 7/1991 | Wiggins . | |
| 5,197,149 | 3/1993 | Overton . | |
| 5,295,269 | 3/1994 | Ballard | 2/161.1 X |
| 5,399,153 | 3/1995 | Caprio, Jr. et al. | 602/62 X |

*Primary Examiner*—C. D. Crowder
*Assistant Examiner*—Shirra L. Jenkins
*Attorney, Agent, or Firm*—Foley & Lardner

[57] ABSTRACT

A weightlifting glove for compressing and supporting the back of the hand and wrist including a glove body and an elongated strap that wraps diagonally about the back of the hand to provide backhand muscle support. The part of the strap that extends diagonally over the back of the hand is inelastic to provide maximum support, while a portion of the remainder of the strap is elastic to provide for compression and adjustability. The glove body preferably has a wrist vent to which a tab closure is provided to allow the glove to fit easily onto the wearer's hand and to permit adjustment of the fit of the glove independently of the strap.

15 Claims, 2 Drawing Sheets

WEIGHTLIFTING GLOVE

FIELD OF THE INVENTION

This invention relates to a weightlifting glove, more specifically to a glove which compresses and supports the hand and wrist during weightlifting and similar activities.

BACKGROUND OF THE INVENTION

Various types of gloves have been created with unique strap configurations. In general, the design of these gloves and their associated straps are adapted for a particular activity. For example, U.S. Pat. No. 2,852,779 issued to Roessler on Jan. 12, 1955 and U.S. Pat. No. 3,105,972 issued to Christopher on Oct. 8, 1963 disclose gloves having elastic support straps adapted for positioning about a hand that is gripping the shaft of a golf club or other implement. The elastic support strap holds the palm and fingers of the wearer's hands against the gripped shaft to augment the force of the wearers' grip on the shaft. Small wrist straps or tabs have also been used with Velcro closures in sports and other kinds of gloves to secure the glove on the hand. See, for example, Fabry U.S. Pat. Nos. 4,684,123, issued Aug. 4, 1987 and 4,850,341, issued Jul. 25, 1989. U.S. Pat. No. 5,197,149 issued to Overton on Mar. 30, 1993 discloses an athletic glove having an elastic back strap which may be wrapped around a wearer's hand to provide support for backhand muscles.

The present invention is designed to meet the specific needs of weightlifting. Some weightlifting exercises require the lifter to press and support large amounts of weights with the backhand muscles and wrist in a flexed position. Thus, it is desirable to provide a weightlifting glove which allows the wearer limited freedom to flex his or her hands and wrists during weightlifting while at the same time providing backhand and wrist support and protection.

The glove described in the foregoing patent to Overton provides these effects to some extent, but the use of an elastic diagonal strap does not support the back of the hand as effectively as can be obtained by combining an inelastic portion for increased support and an elastic portion for tension and adjustability. Likewise, the closure system described in the Overton patent is proximate to the center of the back of the hand, which, due to flex in that area, is not as secure a closure as can be obtained by locating the closure at the wrist. The present invention addresses these drawbacks.

SUMMARY OF THE INVENTION

A weightlifting glove according to the invention for compressing and supporting the back of the hand and wrist of a wearer includes a glove body and an elongated strap permanently secured at one end thereof to the glove body. The strap wraps diagonally about the back portion of the glove body and around the wrist cuff to which the free end of the wrap is releasably secured. The portion of the strap that extends diagonally over the back of the hand is inelastic to provide support, while a segment of the remainder of the strap is elastic to provide tension and adjustability.

In particular, a glove of the invention suitable for weightlifting and similar activities includes a glove body having a palm portion joined with a back portion and a rear wrist cuff, and an elongated backhand strap secured at one end thereof to the glove body near to and rearwardly of the little-finger portion at a position that permits the strap to be wrapped diagonally over the back portion of the glove body, under the wrist cuff and then over the wrist cuff at least about one turn. The backhand strap may be releasably secured to the wrist cuff by a first releasable fastener comprising a pair of cooperating fastener elements, one of which is secured proximate the free end of the strap, and the other which is secured to the wrist cuff so that the strap may be releasably secured in a wrapped position about the back of the wearer's hand and wrist.

According to a further aspect of the invention, the glove body has a vent extending lengthwise from the wrist cuff part way through the length of the glove body, and a second fastener, such as a tab secured to the glove body on one side of the vent having a Velcro element that can engage a second Velcro element on the other side of the vent, permitting the fit of the glove to be adjusted independently of the strap.

These and other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The invention will be further described with reference to the accompanying drawings, wherein like numerals denote like elements.

DETAILED DESCRIPTION OF PREFERRED EMBODIMENTS

Figure 1:
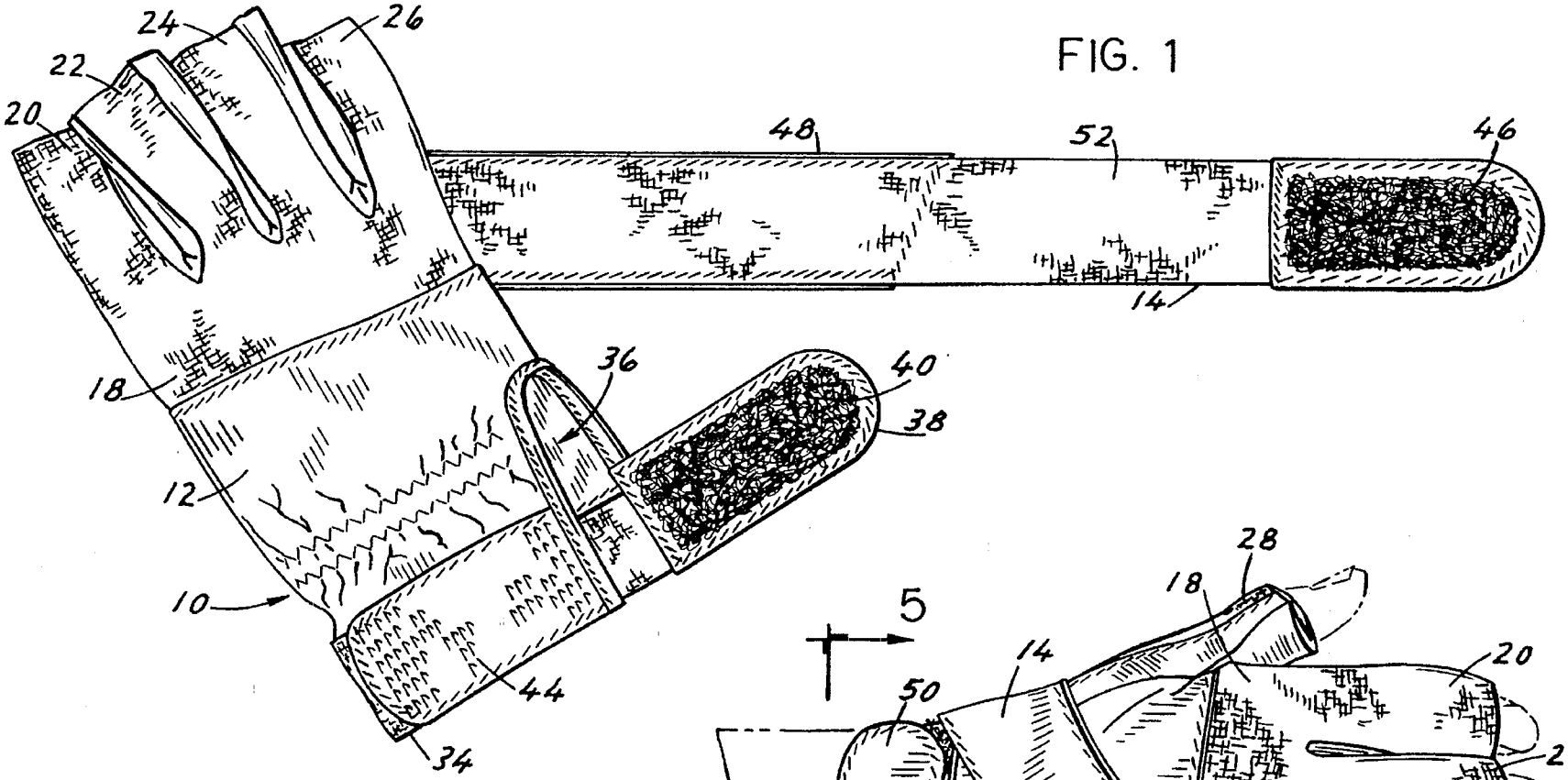
FIG. 1 is a top view of a glove according to the invention with the strap shown fully extended.

With further reference to the drawings, a weightlifting glove 10 includes a glove body 12 and an elongated backhand and wrist support strap 14. Glove body 12 includes a palm portion 16 joined with a back portion 18, four half-finger portions 20, 22, 24, and 26, and a half-thumb portion 28. It will be understood that although the half-finger portions are a style customarily used in weightlifting gloves, the half-finger portions could be replaced with full-finger portions or no finger-coverings at all. Palm portion 16 is preferably made of leather, and includes a protective palm pad 30 sewn inside of palm 16 along seams 32 with a conventional inner lining (not shown). Pad 30 is positioned to be between the palm of a wearer and an item grasped by the wearer, such as a barbell.

Glove body 12 further comprises a wrist cuff 34 forming the lower portion of the glove body adjacent to the hand opening on both the palm side and the back side, and is constructed of an elastic material to provide for adjustability of fit. Glove body 12 has a split (or vent) 36 therein which extends from the wrist cuff 34 thereof not more than about halfway through the length of body 12, preferably to a position aligned with the base of thumb portion 28 on the opposite side from vent 36. Vent 36 extends lengthwise along the palm heel of the wearer's hand, between palm portion 16 and back portion 18.

Wrist cuff 34 includes a lateral tab 38 sewn directly to the palm portion of the wrist cuff along a lengthwise seam of the vent. Tab 38 comprises a loop element 40 of a hook and loop fastener, i.e., a Velcro fastener, sewn to the inside thereof, and a hook element 42 sewn to the outside thereof. Inside loop element 40 is for adjustable engagement with a hook element 44 sewn to the back portion of wrist cuff 34 on the other side of vent 36, and outside hook element 42 is for engagement with a loop element portion 46 secured along a free end of strap 14. The resulting releasable fasteners can be used to adjust the fit of the glove to the hand independently of diagonal strap 14. It will be understood that positions of the hook and loop elements used in the invention may be switched.

Figure 3:
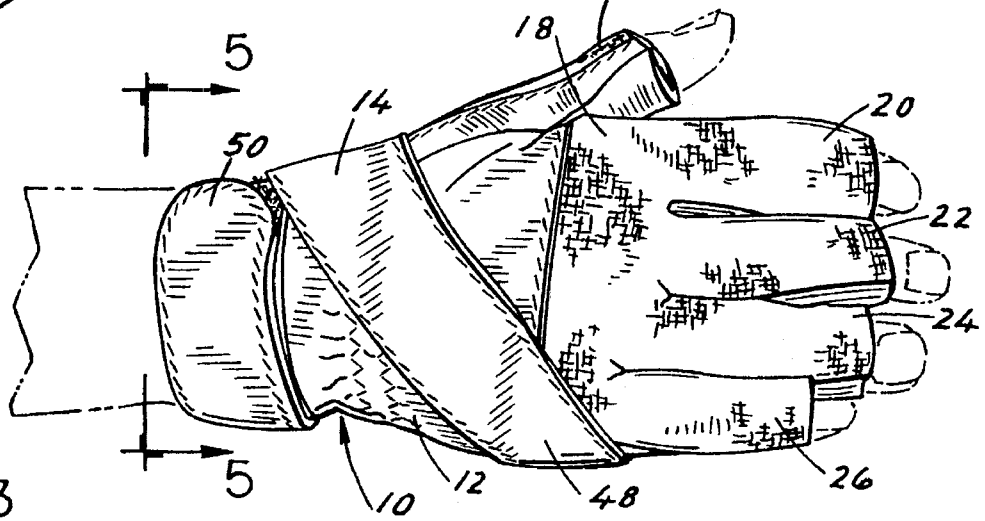
FIG. 3 is a top view of the glove of FIG. 1 with the strap shown wrapped around the wrist of the wearer.
Figure 2:
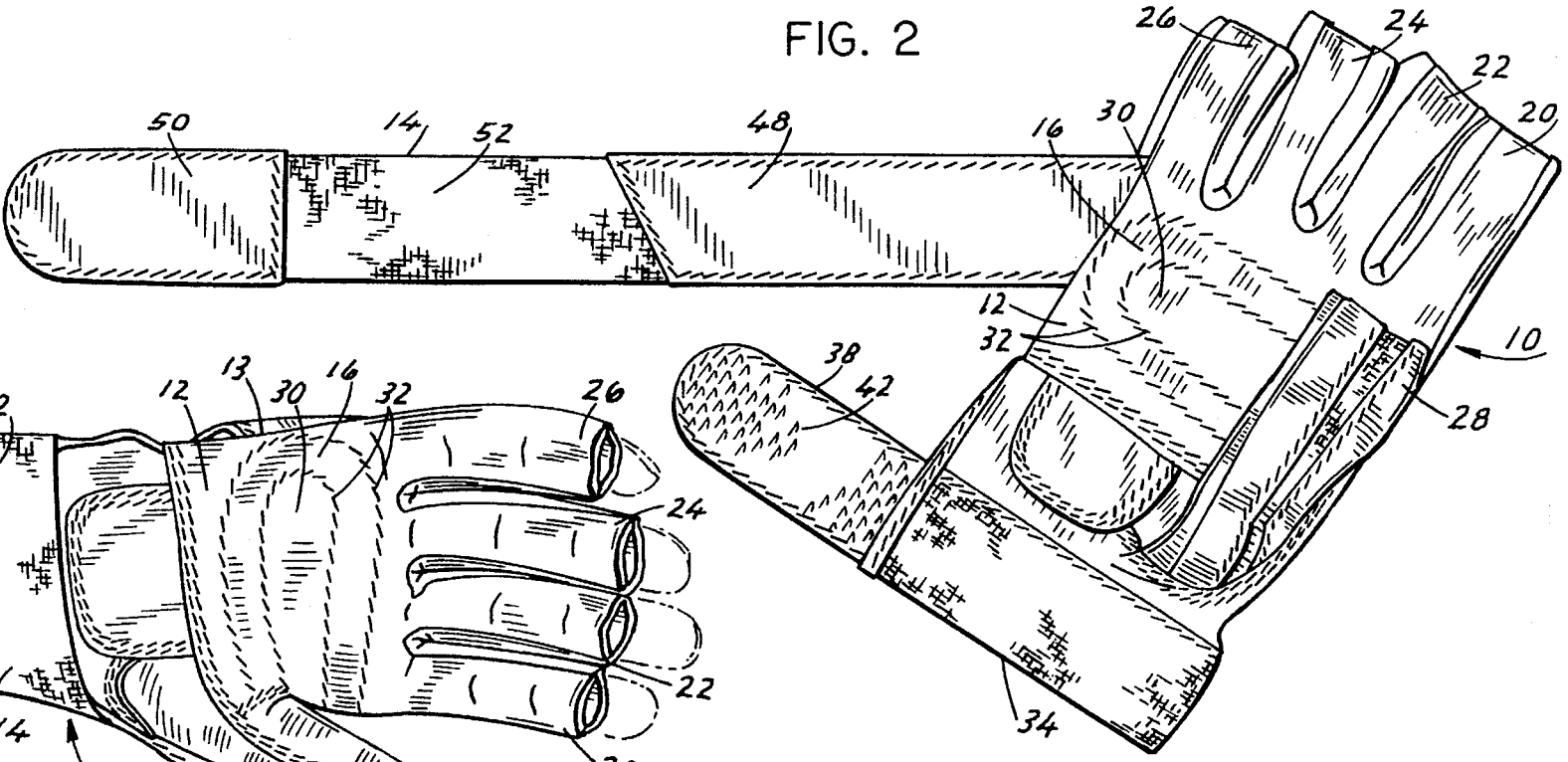
FIG. 2 is a bottom view of the glove of FIG. 1.
Figure 5:
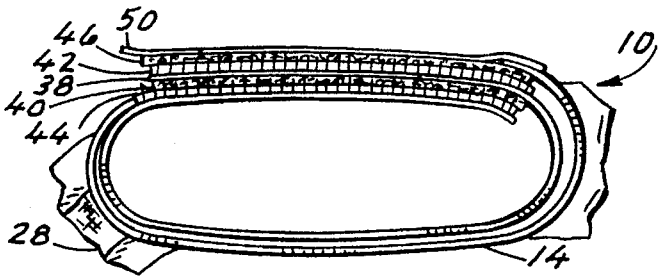
FIG. 5 is a rear perspective view of the glove of FIG. 1 with the strap shown wrapped around the wrist of the wearer.
Figure 4:
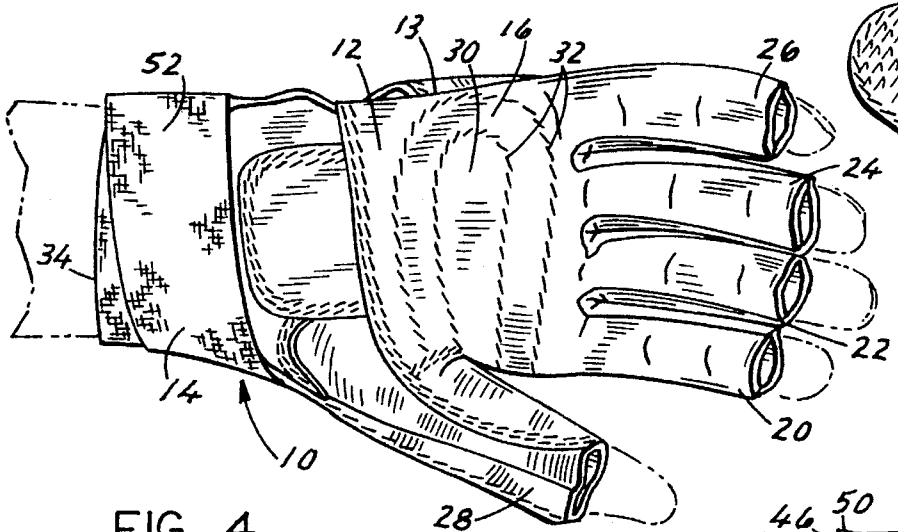
FIG. 4 is a bottom view of the glove of FIG. 1 with the strap shown wrapped around the wrist of the wearer.

Strap 14 is sewn at one end thereof directly to glove body 12 along a lengthwise seam 13 formed between palm portion 16 and back portion 18 near to and rearwardly of little-finger portion 26. After putting on the glove 10, the wearer wraps strap 14 diagonally across the back of the wearer's hand and then stretches it around the wrist. Strap 14 thereby extends from the base of little-finger portion 26 to wrist cuff 34 rearwardly of the base of thumb portion 28, as shown in FIGS. 3 and 4. Strap 14 is then stretched under wrist cuff 34 and then over wrist cuff 34 at least about one turn. The free end of strap 14 is then releasably secured to wrist cuff 34 by means of fastener elements 42, 46.

Strap 14 is preferably composed of a length of neoprene or other stretchable material with a portion 48 of strap 14 made inelastic by sewing a segment of inelastic material such as leather to the outside of the elastic strap material. The inelastic portion 48 extends from the attachment point of strap 14 to the seam 13 to about half way to its free end, covering approximately the portion of strap 14 that extends diagonally over the back of the hand when strap 14 is wrapped around the wearer's hand. Loop fastener element 46 is sewn to the free end of strap 14 on the inside of a segment of inelastic material 50 sewn to the end of strap 14. The remaining segment of strap 14, extending from the distal end of inelastic portion 48, under the wrist cuff and then over the wrist cuff, forms an elastic midportion 52.

Since fastener elements 42 and 44, affixed to outside of tab 38 and the back portion of wrist cuff 34 respectively, are both of the hook element type, the loop type fastener 46 affixed to the free end of strap 14 can be releasably secured to either element 42 alone, or to both elements 42 and 44 in the event that hook element 44 isn't completely covered by tab 38. It is understood that hook element 44 sewn to the back portion of the wrist cuff could be extended to cover a portion of the front of the wrist cuff, increasing the portion of hook element 44 not covered by the tab, and allowing for strap 14 to be secured to element 44 alone, in which case element 42 could be omitted.

The foregoing features permit strap 14 to be positioned across the back of the hand, but the combination of an inelastic portion and an elastic portion permits strap 14 to provide better support to the back of the hand while still maintaining the flexibility and adjustability required during some weightlifting activities. Additionally, since the free end of strap 14 is secured directly to the wrist cuff, which does not flex as much as the center of the back of the hand, the releasable closure is less likely to inadvertently break loose, and consequently does not require a separate hold-down strap.

Once secured, strap 14 provides support to the backhand muscles and wrist to reduce fatigue and to prevent over-straining. The degree of support can be selectively varied by the wearer by changing the amount to which strap 14 is stretched. In particular, the more strap 14 is stretched, the more support is provided.

While a particular embodiment of the present invention has been shown and described, modifications may be made within the scope of the invention. For example, the hook and loop fasteners employed by the described embodiment may be replaced with other types of fasteners, such as metal snaps, belt closures, buttons or the like. It is intended in the appended claims to cover all such changes and modifications which fall within the spirit of the invention.

I claim:

1. A glove, comprising:

a glove body having a palm portion joined with a back portion, four finger portions, including a little-finger portion, a thumb portion, and a rear wrist cuff;

an elongated strap secured at one end thereof to the glove body at a position that permits the strap to be wrapped diagonally over the back portion of the glove body, then around the wrist cuff at least about one turn; and a first releasable fastener including a pair of cooperating fastener elements, one of which is secured proximate a free end of the strap, and the other of which is secured to the wrist cuff so that, upon winding of the strap diagonally over the back portion of the glove body, under the wrist cuff and then over the wrist cuff, the free end of the strap may be releasably secured to the wrist cuff.

2. The glove of claim 1, wherein the first releasable fastener is a hook-and-loop fastener that permits the strap to be secured in a series of positions under varying tension.

3. The glove of claim 1, wherein the strap comprises an inelastic portion which extends from the glove body to the wrist cuff when the strap is secured diagonally over the back of a hand, and an elastic portion which extends from a free end of the inelastic portion around the wrist cuff when the inelastic portion of the strap extends diagonally over the back of the hand.

4. The glove of claim 1, wherein the elongated strap is secured at one end thereof to the glove body near to and rearwardly of the little-finger portion.

5. The glove of claim 4, wherein the fastener element secured to the wrist cuff is secured to a back of the wrist cuff adjacent the back portion of the glove body.

6. The glove of claim 1, wherein the fastener element secured to the wrist cuff is secured to a back of the wrist cuff adjacent the back portion of the glove body.

7. The glove of claim 1, wherein the strap has a length suitable for wrapping the strap diagonally over the back portion of the glove body, under the wrist cuff and then over the wrist cuff, so that a remote end of the strap is secured to a back of the wrist cuff in parallel therewith and proximate to a diagonally extending portion of the strap.

8. The glove of claim 7, wherein the strap has a length suitable for wrapping approximately one full turn around the wrist.

9. A glove, comprising:

a glove body having a palm portion joined with a back portion, four finger portions, including a little-finger portion, a thumb portion, and a rear wrist cuff;

an elongated strap secured at one end thereof to the glove body at a position that permits the strap to be wrapped diagonally over the back portion of the glove body, under the wrist cuff and then over the wrist cuff at least about one turn; and a first releasable fastener including a pair of cooperating fastener elements, one of which is secured proximate a free end of the strap, and the other of which is secured to the wrist cuff so that, upon winding of the strap diagonally over the back portion of the glove body, under the wrist cuff and then over the wrist cuff, the free end of the strap may be releasibly secured to the wrist cuff;

wherein the glove body has a vent extending lengthwise from the wrist cuff part way through the length of the glove body along a palm heel portion thereof towards a seam at which the strap is secured to the glove body, and the glove further comprises a second fastener usable to secure the glove on a wearer's hand independently of the strap, including a tab secured to the palm portion of the glove body on one side of the vent, and a second releasable fastener including a pair of cooperating fastener elements, one of which is secured to the wrist cuff on the back portion of the glove body and the other of which is secured to an underside of the tab, so that the tab may be releasibly secured to the wrist cuff with the tab extending over the vent.

10. The glove of claim 9, wherein the second releasable fastener comprises hook and loop fastener elements.

11. The glove of claim 10, wherein the first releasable fastener is a hook-and-loop fastener that permits the strap to be secured in a series of positions under varying tension, including hook and loop fastener elements, one of which is secured to the wrist cuff, and the other of which is secured to the strap.

12. The glove of claim 6, wherein the tab and strap can be secured to the same fastener element secured to the wrist cuff when the strap is wound over the tab.

13. The glove of claim 6, wherein the tab has fastener elements on both sides thereof, so that the strap can be secured to an outside of the tab when the strap is wound over the tab.

14. The glove of claim 9, wherein the elongated strap is secured at one end thereof to the glove body near to and rearwardly of the little-finger portion.

15. The glove of claim 9, wherein the fastener element secured to the wrist cuff is secured to a back of the wrist cuff adjacent the back portion of the glove body.

* * * * *